US011089848B2

(12) United States Patent
Humbert

(10) Patent No.: US 11,089,848 B2
(45) Date of Patent: Aug. 17, 2021

(54) INSERT FOR A WATCH BRACELET

(71) Applicant: OMEGA SA, Biel/Bienne (CH)

(72) Inventor: Karl Humbert, Chenecey Buillon (FR)

(73) Assignee: OMEGA SA, Biel/Bienne (CH)

( * ) Notice: Subject to any disclaimer, the term of this patent is extended or adjusted under 35 U.S.C. 154(b) by 0 days.

(21) Appl. No.: 16/808,702

(22) Filed: Mar. 4, 2020

(65) Prior Publication Data

US 2020/0315304 A1 Oct. 8, 2020

(30) Foreign Application Priority Data

Apr. 3, 2019 (EP) ..... 19167058

(51) Int. Cl.
*A44C 5/14* (2006.01)

(52) U.S. Cl.
CPC ..... *A44C 5/145* (2013.01)

(58) Field of Classification Search
CPC ..... A44C 5/145; Y10T 24/4782
See application file for complete search history.

(56) References Cited

U.S. PATENT DOCUMENTS 1,597,417 A 8/1926 Rioux
1,630,498 A * 5/1927 Person ..... A44C 5/145 24/600.9
1,666,033 A * 4/1928 Nittel ..... A44C 5/145 63/5.2
1,666,864 A 4/1928 Nittel
1,677,101 A * 7/1928 Nittel ..... A44C 5/145 24/599.6
1,715,153 A * 5/1929 Wallenthin ..... A44C 5/145 24/601.5
1,760,384 A 5/1930 Tost
3,581,960 A * 6/1971 Ojima ..... A44C 5/145 24/265 WS

FOREIGN PATENT DOCUMENTS

CH 707056 A2 4/2014
CN 109393668 A 3/2019
(Continued)

OTHER PUBLICATIONS

Communication dated Aug. 13, 2019, issued by the European Patent Office in counterpart European Application No. 19167058.
(Continued)

*Primary Examiner* — Robert Sandy
(74) *Attorney, Agent, or Firm* — Sughrue Mion, PLLC

(57) ABSTRACT

An insert (1) for a watch bracelet strand (10), the insert being intended to be attached to the end of the strand. The insert includes a housing for a bar (20) of the watch case, the housing being formed by a curved portion (4) of a rigid element (2) which includes a flat portion (3) extended by said curved portion (4). The insert further includes a bolt (12) preferably made of plastic which is articulated with respect to two arms (11) mounted on the flat portion (3) of the rigid element (2). The bolt (12) includes a closure wall (15), at least one portion of which is formed by the wall (21) of at least one elastic tab (16). The closure wall (15) will close the housing in the locked position, by the edge (17) of the hook-shaped portion (4) which interlocks with a notch (22) arranged in the wall (21) of the tab (16).

12 Claims, 3 Drawing Sheets

(56) References Cited

FOREIGN PATENT DOCUMENTS

| | | | |
|---|---|---|---|
| DE | 26 08 453 | A1 | 10/1976 |
| FR | 2350808 | A1 | 12/1977 |
| JP | 37-12493 | Y | 6/1962 |
| JP | 43-10221 | Y | 5/1968 |
| JP | 49-53767 | U | 5/1974 |
| JP | 52-13989 | Y1 | 3/1977 |
| JP | 56-174518 | U | 12/1981 |
| JP | 2000-353506 | A | 12/2000 |
| JP | 2004-141608 | A | 5/2004 |
| JP | 2017-205260 | A | 11/2017 |

OTHER PUBLICATIONS

Office Action dated Mar. 16, 2021 in Japanese Application No. 2020-067341.

* cited by examiner

INSERT FOR A WATCH BRACELET

CROSS REFERENCE TO RELATED APPLICATIONS

This application is based on and claims priority under 35 USC 119 from European Patent Application No. 19167058.7 filed Apr. 3, 2019, which is incorporated herein by reference in its entirety.

FIELD OF THE INVENTION

The present invention concerns a device for attaching bracelet strands to a watch case that allows said bracelet strands to be assembled to and disassembled from the case without tools.

STATE OF THE ART

U.S. Pat. No. 2,850,783 discloses a watch bracelet comprising expansible metal strands, which are each provided, at one end thereof, with a system comprising a housing extending transversely to the longitudinal direction of the bracelet strand and provided with a transverse opening. The housing is intended to receive a bracelet attachment pin extending between the inner faces of the horns of a watch case. The housing is provided with a cover plate movable between a locked position in which it closes the transverse opening and thus retains the bar inside the housing and thereby attaches the bracelet strand to the case, and an unlocked position in which the cover plate is disengaged from the transverse opening and which allows the wearer of the watch to disengage the bar from the housing and thus separate the bracelet strand from the watch. The cover plate is locked by means of strips bent at 90° and integral with the cover plate, which ensure friction locking on a rigid edge of the housing. The friction forces involved are relatively low, given their small width and the small thickness of the edge against which they bear. Further, after several locking/unlocking cycles, these strips are susceptible to plastic deformation and thus no longer ensure reliable engagement, or even, at worst, are susceptible to breakage and could result in the watch being dropped or lost. It will also be noted that this system has three folded sheet metal parts which are quite complex, which makes the system difficult and expensive to produce.

SUMMARY OF THE INVENTION

It is a main object of the present invention to provide a device for attaching bracelet strands to a watch case that allows said bracelet strands to be assembled to and disassembled from the case without tools.

It is also an object of the present invention to provide a wristwatch wherein the bracelet strands are provided with a device for the manual locking and unlocking of the connection between the bars of the watch case and the strands of the watch bracelet, said system being simple and easy to produce, while ensuring secure locking.

It is also an object of the present invention to provide an insert capable of integration in a bracelet strand, said insert allowing the bracelet strand to be assembled to and disassembled from a bar of a watch case without tools.

This object is achieved by an insert, a bracelet strand and a watch according to the annexed claims.

The invention concerns an insert for a watch bracelet strand, the insert being intended to be attached to the end of the strand. The insert comprises a rigid body provided with a flat portion and a curved portion defining a housing for a bar of the watch case. The housing extends transversely to the longitudinal direction of the bracelet strand and is provided with a transverse opening. The curved portion is extended by a flat portion. The insert further comprises a bolt, preferably made of plastic, which is articulated with respect to two arms integral with the flat portion of the rigid element in order to pivot about an axis perpendicular to the longitudinal direction of the bracelet strand. The bolt comprises a closure wall, at least one portion of which is formed by the wall of at least one elastic tab. The bolt can pivot between two positions, a first position called the locked position in which the closure wall closes the housing, as the edge of the hook-shaped portion enters a notch provided in the wall of the tab. In a second position, called the unlocked position, the edge of the hook-shaped portion is released from the notch provided in the wall of the tab and the bolt is free to pivot about its axis and thereby clear the transverse opening of the housing.

The insert according to the invention comprises two main components, notably the rigid element and the bolt, the first of which is essentially a flat rigid plate extended by a curved portion and comprising two arms protruding from the flat portion of the plate. This metal or other rigid material component is simple and inexpensive to manufacture. The other component (the bolt) can easily be made of plastic material, also at a reduced cost. Further, locking by means of interlocking elements ensures that the connection between the watch case and the bracelet achieved by an insert according to the invention is ensured in all circumstances.

Other features and advantages of the present invention will appear in the following description of preferred embodiments, given by way of non-limiting example, with reference to the annexed drawings.

DETAILED DESCRIPTION OF EMBODIMENTS OF THE INVENTION

Figure 1:
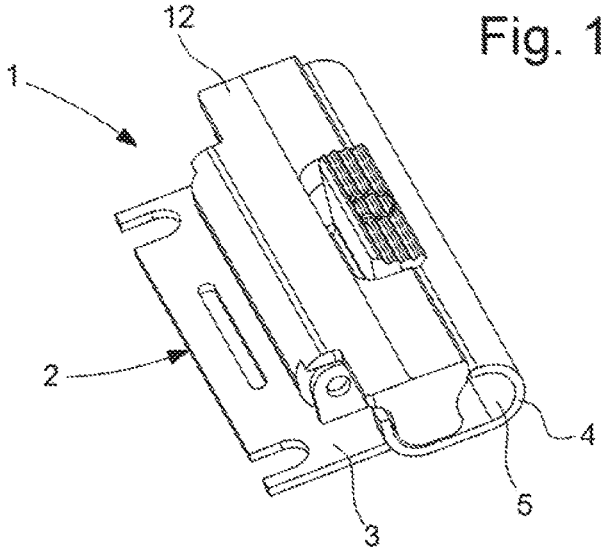
FIG. 1 represents an insert according to one embodiment of the invention.
Figure 2:
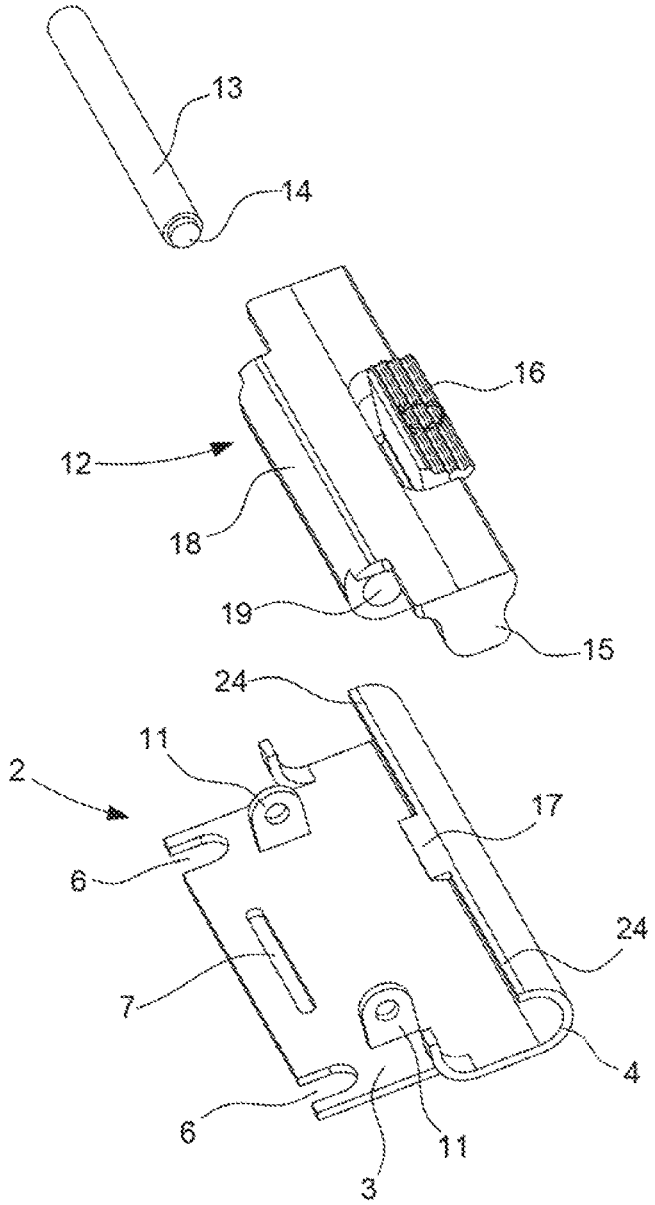
FIG. 2 is an exploded view detailing the components of the insert of FIG. 1.

The insert represented in FIGS. 1 and 2 comprises firstly a body 2 made of rigid material, which includes a flat portion 3 extended by a hook-shaped end portion 4 which defines a housing 5 intended to receive a bar of a watch case (not represented). Housing 5 extends transversely to the longitudinal direction of the bracelet strand and is provided with a transverse opening 5*a*. Body 2 is preferably a plate, one end of which is curved to form the housing. Preferably, the plate is made of metal.

Flat portion 3 comprises notches 6 and a slot 7 for attaching insert 1 to one of the watch bracelet strands. Notches 6 and slot 7 are simply examples of means for attaching the insert. The precise shape of said means may depend on the shape and material of the strands. For example, the insert can be overmoulded with a synthetic material from which the bracelet strand is formed. Alternatively, the insert may be inserted and bonded between two layers of a material from which the strand is formed.

Figure 3:
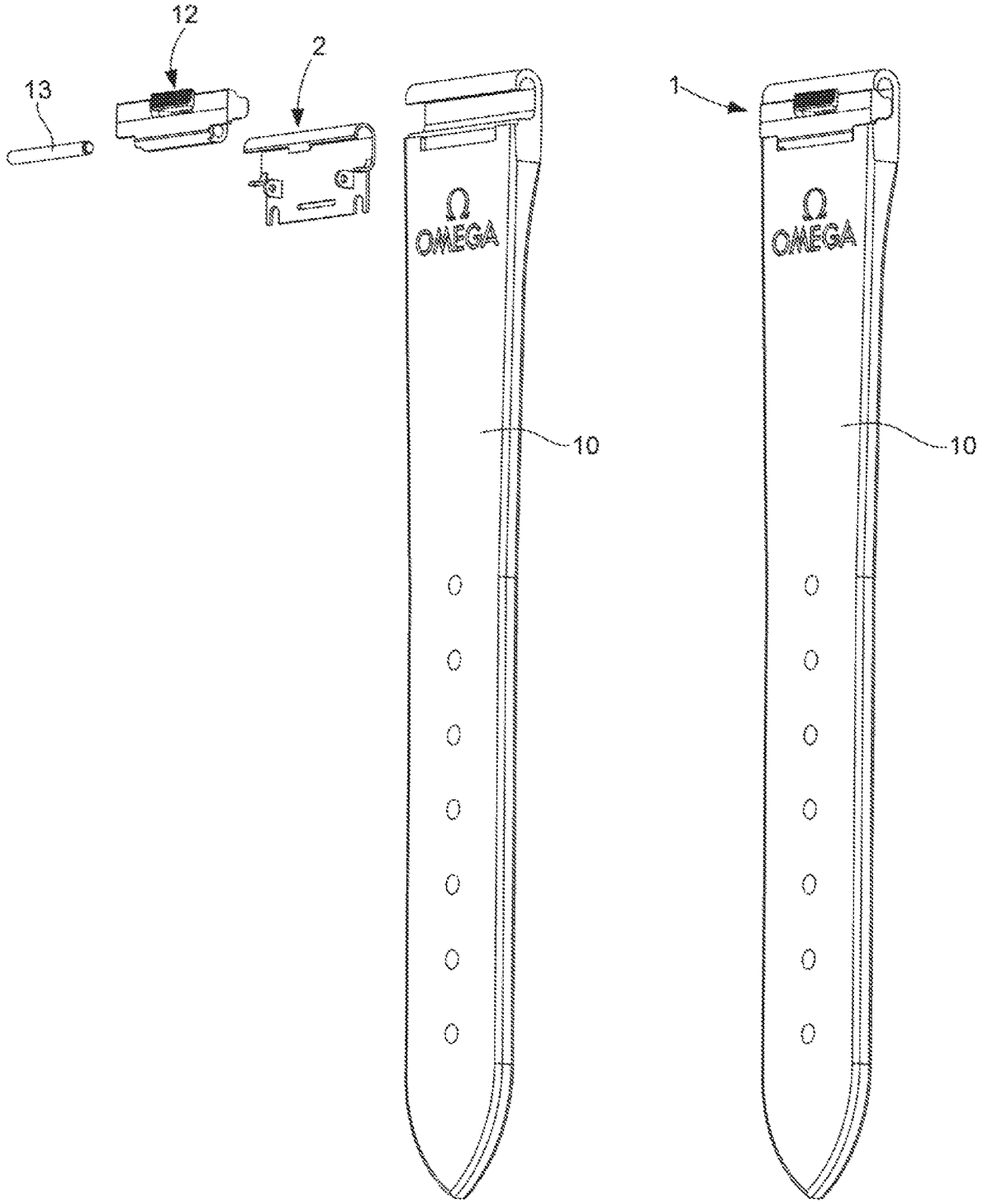
FIG. 3 illustrates the phase of assembling the insert of FIG. 1 in a bracelet strand.

FIG. 3 shows that insert 1 of FIG. 1 is capable of insertion into a leather bracelet strand 10. The means of attachment of the insert may, however, easily be adapted to other bracelet types and materials (ceramic, rubber, metal, etc.).

Returning to FIGS. 1 and 2, it is seen that on flat portion 3 of rigid body 2, two tabs with eyelets 11 have been cut and folded up from the plane of said flat portion 3, to form the two arms 11 of a clevis arranged facing the opening of housing 5, and on which a bolt 12 is articulated about an axis perpendicular to the longitudinal direction of the bracelet. The bolt is arranged to close the opening of the housing in a locked position.

Bolt 12 is a part preferably made of injection moulded plastic, and for example, of ABS (acrylonitrile butadiene styrene). It is mounted to pivot about a pin 13 provided with two trunnions 14 inserted into the eyelets of arms 11 which form a clevis. Preferably, at least one of trunnions 14 is returned outwardly by a spring arranged inside pin 13, like a conventional spring bar, for easy assembly and disassembly of the pin between arms 11.

Bolt 12 comprises a back portion 18 pierced with a longitudinal hole 19 for receiving pin 13 and whose length corresponds to the space between arms 11. Alternatively, the bolt has no hole for receiving a pin 13, but the bolt itself is provided with trunnions or similar which allow rotational assembly of the bolt between arms 11. Instead of trunnions 14 inserted into eyelets, other known pivot mechanisms can be used to articulate the bolt relative to arms 11.

Bolt 12 further comprises a closure wall 15 having a curved face and extending along the longitudinal direction of housing 5, in order to form a closed housing of substantially circular section when bolt 12 is closed. The bolt comprises a locking tab 16 capable of elastic deformation. In the illustrated example, the tab is formed in the median part of closure wall 15 and on one portion thereof. The front wall 21 of tab 16 thus forms, in this example, a part of said closure wall 15. According to a variant that is not represented, the tab can extend over the entire length of the closure wall. Tab 16 is intended to cooperate with the edge 17 of a corresponding central section of the hook-shaped portion 4 of rigid body 2 via a longitudinal notch 22 provided in the upper part of the tab.

Figure 4A:
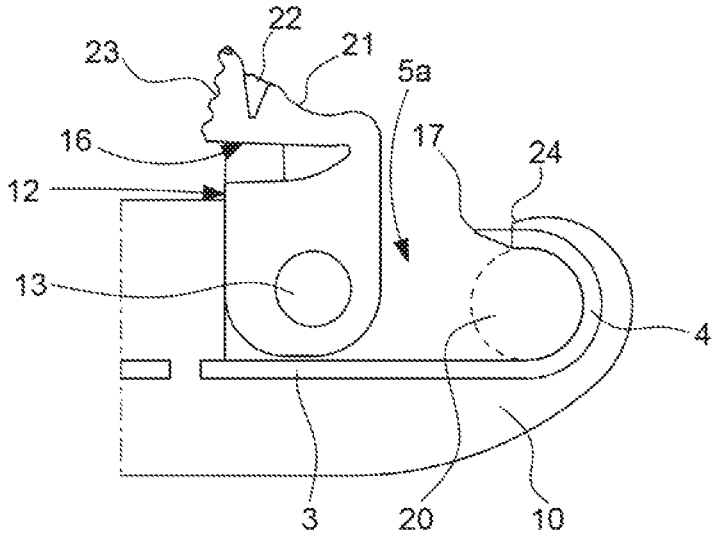
FIGS. 4*a*-4*c* represent the three steps performed when a bar of a watch case is locked using the insert of FIG. 1.
Figure 4B:
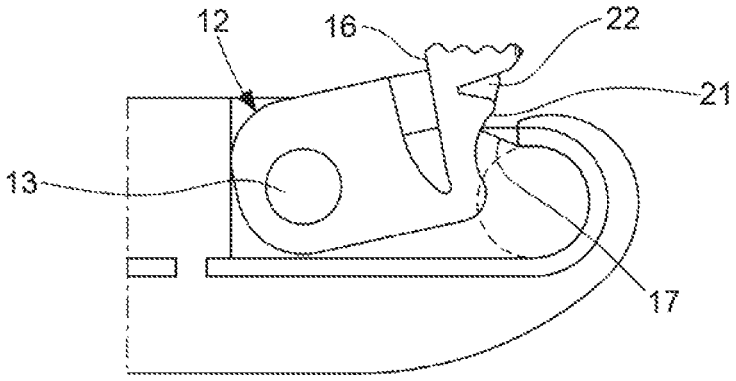
Figure 4C:
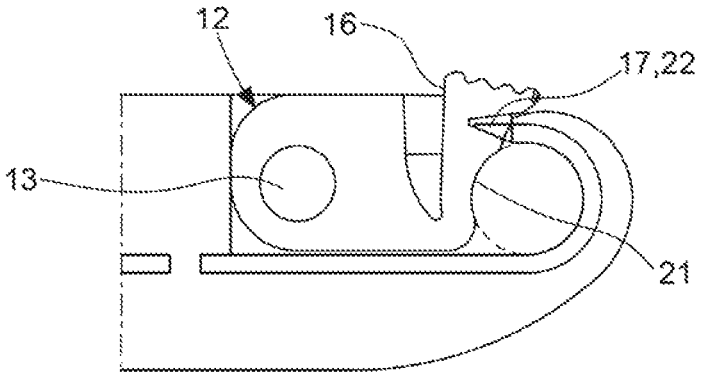

FIGS. 4*a*-4*c* illustrate the operation of bolt 12. In the open or unlocked position (FIG. 4*a*), bar 20 of a watch case is inserted into the housing formed by the hook-shaped end 4 of rigid body 2. Then, bolt 12 is tilted towards its closed or locked position (FIG. 4*b*). Front wall 21 of tab 16 is curved to form a housing of circular cross-section for bar 20 when the tab is closed. In the upper part of said wall 21, a longitudinal notch 22 is provided. The dimensions of bolt 12 are such that, when the bolt is tilted, front wall 21 comes into contact with edge 17. Due to the curved shape of wall 21, tab 16 is held backwards by edge 17. Then, when the user pushes bolt 12 into its locked position, the elasticity of tab 16 allows wall 21 to bend backwards and then elastically return to edge 17, such that the latter enters notch 22 (FIG. 4*c*) and locks the bolt in the locked position.

To open the tab, the user will push tab 16 backwards until edge 17 is released from notch 22, and then tilt bolt 12 into its open position. Preferably, the upper surface of tab 16 is textured, for example with grooves 23, to increase friction with the user's finger. As shown in a sectional view in FIGS. 4*a*-4*c*, the portion of edge 17 of hook-shaped portion 4 which interlocks with notch 22 is preferably pointed, thereby having a shape that corresponds to the internal shape of notch 22. Other forms of notches and corresponding edges can, however, be envisaged.

FIGS. 3 and 4 also show how insert 1 is integrated in a leather bracelet strand 10. The end of strand 10 is folded around the outer face of hook-shaped portion 4 and placed against a pair of rails 24 mounted on the parts of the edge that lie either side of the tab 16 (FIG. 2). This structure is not limiting and the manner in which the strand is attached to the insert may vary according to the material of the strand, for example. Tab 16 may vary in its longitudinal dimensions (in the longitudinal direction of housing 5).

According to one embodiment, the tab extends over the entire length of housing 5. According to another embodiment, several tabs are arranged over this length, for example two tabs on either side of the central vertical plane of the insert.

The clevis arms 11 can be made in a different manner from the embodiment represented in the Figures. Instead of cutting and folding up parts of flat portion 3, arms 11 may be components that are attached, for example welded to flat portion 3.

The rigid material body 2 is preferably a uniform part made of only one material. It is, however, possible to make body 2 by assembling a flat portion 3 to a curved portion 4, said portions being made of the same material or of different materials.

The invention claimed is:

1. An insert (1) for a watch bracelet strand (10), allowing manual locking and unlocking of the connection between the strand (10) and a bar (20) of a watch case, characterized in that the insert (1) has a body (2) made of rigid material and a bolt (12), the body (2) made of rigid material comprising a flat portion (3) extended by a hook-shaped portion (4) ending in an edge (17), said hook-shaped portion (4) forming a housing (5) for the bar (20), the housing comprising a transverse opening, the flat portion (3) being configured to be attached to one end of the strand (10), the flat portion (3) comprising means of articulating said bolt arranged facing the opening of the housing (5) in order to pivot the bolt about an axis of articulation parallel to the opening, said bolt (12) comprising a closure wall (15) capable of closing said housing (5), and at least one tab (16) capable of elastic deformation, the tab (16) comprising a wall (21) which forms at least one part of the closure wall (15), and a notch (22) arranged in said wall (21), and wherein said wall (21) of the tab (16) and the notch (22) are configured such that:

when the bolt (12) is pivoted and pushed manually into a locking position in which the closure wall closes the transverse opening of the housing, the tab (16) deforms elastically until at least one part of the edge (17) of the hook-shaped portion (4) enters the notch (22) and when the tab (16) is manually pulled in an opposite direction to the hook-shaped portion (4), said at least one part of the edge (17) of the hook-shaped portion (4) is released from the notch (22), the bolt (12) is free to pivot about its axis of articulation and clears the transverse opening of the housing thereby bringing the bolt (12) into an unlocking position.

2. The insert (1) according to claim 1, comprising a single tab (16) whose wall (21) forms a central part of the closure wall (15).

3. The insert (1) according to claim 2, wherein the edge (17) is provided with rails (24) on either side of the part of the edge (17) that interlocks with the notch (22) in the locked position of the bolt (12).

4. The insert (1) according to claim 1, wherein the tab (16) is provided with a structured upper surface (23) facilitating the locking and unlocking of the bolt (12) by a user.

5. The insert (1) according to claim 1, wherein the body made of rigid material (2) is a uniform plate curved on one side to form the hook-shaped portion (4).

6. The insert (1) according to claim 5, wherein the plate is made of metal.

7. The insert (1) according to claim 1, wherein the articulation means are formed by a pair of clevis arms (11) arranged in the flat portion (3) of the body (2) to form a clevis.

8. The insert (1) according to claim 7, wherein the clevis arms forming the clevis are formed by parts of the flat portion (3) which are cut and folded up with respect to the plane of the flat portion.

9. The insert (1) according to claim 7, further comprising a pin (13) mounted between the clevis arms (11), and wherein the pin (13) is inserted into a hole (19) provided in the bolt (12), so that the bolt (12) is pivotably mounted with respect to the pin (13).

10. The insert (1) according to claim 9, wherein the pin (13) is provided with trunnions (14) at both ends thereof, and wherein the clevis arms (11) are provided with eyelets shaped to receive said trunnions (14) of the pin (13).

11. A watch bracelet strand (10) comprising at one end an insert (1) for a watch bracelet strand (10), allowing manual locking and unlocking of the connection between the strand (10) and a bar (20) of a watch case, characterized in that the insert (1) has a body (2) made of rigid material and a bolt (12), the body (2) made of rigid material comprising a flat portion (3) extended by a hook-shaped portion (4) ending in an edge (17), said hook-shaped portion (4) forming a housing (5) for the bar (20), the housing comprising a transverse opening, the flat portion (3) being configured to be attached to one end of the strand (10), the flat portion (3) comprising means of articulating said bolt arranged facing the opening of the housing (5) in order to pivot the bolt about an axis of articulation parallel to the opening, said bolt (12) comprising a closure wall (15) capable of closing said housing (5), and at least one tab (16) capable of elastic deformation, the tab (16) comprising a wall (21) which forms at least one part of the closure wall (15), and a notch (22) arranged in said wall (21), and wherein said wall (21) of the tab (16) and the notch (22) are configured such that:

when the bolt (12) is pivoted and pushed manually into a locking position in which the closure wall closes the transverse opening of the housing, the tab (16) deforms elastically until at least one part of the edge (17) of the hook-shaped portion (4) enters the notch (22) and when the tab (16) is manually pulled in an opposite direction to the hook-shaped portion (4), said at least one part of the edge (17) of the hook-shaped portion (4) is released from the notch (22), the bolt (12) is free to pivot about its axis of articulation and clears the transverse opening of the housing thereby bringing the bolt (12) into an unlocking position.

12. A watch provided with a watch case and two strands (10) on either side of the case, the case being provided with two bars (20), and wherein the bars (20) of the case are attached to the strands (10) by two inserts (1) for a watch bracelet strand (10), allowing manual locking and unlocking of the connection between the strand (10) and a bar (20) of a watch case, characterized in that each insert (1) has a body (2) made of rigid material and a bolt (12), the body (2) made of rigid material comprising a flat portion (3) extended by a hook-shaped portion (4) ending in an edge (17), said hook-shaped portion (4) forming a housing (5) for a respective bar (20), the housing comprising a transverse opening, the flat portion (3) being configured to be attached to one end of a respective strand (10), the flat portion (3) comprising means of articulating said bolt arranged facing the opening of the housing (5) in order to pivot the bolt about an axis of articulation parallel to the opening, said bolt (12) comprising a closure wall (15) capable of closing said housing (5), and at least one tab (16) capable of elastic deformation, the tab (16) comprising a wall (21) which forms at least one part of the closure wall (15), and a notch (22) arranged in said wall (21), and wherein said wall (21) of the tab (16) and the notch (22) are configured such that:

when the bolt (12) is pivoted and pushed manually into a locking position in which the closure wall closes the transverse opening of the housing, the tab (16) deforms elastically until at least one part of the edge (17) of the hook-shaped portion (4) enters the notch (22) and when the tab (16) is manually pulled in an opposite direction to the hook-shaped portion (4), said at least one part of the edge (17) of the hook-shaped portion (4) is released from the notch (22), the bolt (12) is free to pivot about its axis of articulation and clears the transverse opening of the housing thereby bringing the bolt (12) into an unlocking position.

* * * * *